US005084994A

United States Patent [19]

Elmer

[11] Patent Number: 5,084,994

[45] Date of Patent: Feb. 4, 1992

[54] ADJUSTABLE VEHICLE-MOUNTED ADVERTISING SIGNS AND METHOD

[76] Inventor: William A. Elmer, 1010 Temple Grove Ct., Winter Park, Fla. 32789

[21] Appl. No.: 546,714

[22] Filed: Jul. 2, 1990

[51] Int. Cl.[5] ..... G09F 21/04

[52] U.S. Cl. ..... 40/591; 40/602; 40/597

[58] Field of Search ..... 40/591, 592, 593, 610, 40/602, 412, 413, 597; 211/88; 87; 224/42.46 R, 42.45 R, 42.42

[56] References Cited

U.S. PATENT DOCUMENTS

| | | | |
|---|---|---|---|
| 914,775 | 3/1909 | Aarons | 40/597 |
| 2,675,983 | 4/1954 | King | 40/591 X |
| 3,153,294 | 10/1964 | Hay et al. | 40/592 |
| 3,284,938 | 11/1966 | Diehl et al. | 40/610 X |
| 3,715,821 | 2/1973 | Hawes | 40/591 |
| 3,828,455 | 8/1974 | Bentley | 40/602 |
| 4,231,501 | 11/1980 | Goode | 224/42.46 R |
| 4,667,428 | 5/1987 | Elmer | 40/597 X |
| 4,976,410 | 12/1990 | Tomaiuolo | 40/591 X |

FOREIGN PATENT DOCUMENTS

| | | | |
|---|---|---|---|
| 2124008 | 2/1984 | United Kingdom | 40/591 |

*Primary Examiner*—Kenneth J. Dorner
*Assistant Examiner*—J. Bonifanti
*Attorney, Agent, or Firm*—Duckworth, Allen, Dyer & Doppelt

[57] ABSTRACT

An advertising display for use above the roof of a vehicle comprises a rigid aerodynamic member, which tapers rearwardly to a trailing edge with an upstanding brace extending into the aerodynamic member and with a window mount fixed to the brace and having a lateral hook portion dimensioned to pass across the top of one of the vehicle's windows. At least one surface of the aerodynamic member defines an area to which an advertising medium can be affixed.

17 Claims, 4 Drawing Sheets

ADJUSTABLE VEHICLE-MOUNTED ADVERTISING SIGNS AND METHOD

BACKGROUND OF THE INVENTION

The present invention relates to advertising signs and message boards which may be removably mounted upon a motor vehicle.

A variety of businesses, particularly in the fast food industry, employ part-time delivery vehicles. Typically, the business will provide the part-time delivery person with a sign which may be easily mounted upon the delivery person's vehicle, but removed at the end of the delivery person's shift and used during the next shift. Examples of roof top-mounted removable advertising signs are disclosed in my earlier U.S. Pat. Nos. 4,667,428; 4,839,975 and D.290,620.

Removable advertising signs of this type may also be removably mounted to the vehicle window. An example of such a product is a fabric "wind sock" advertising sign manufactured by Windword, Inc. of Spokane, Washington.

SUMMARY OF THE INVENTION

The present invention contemplates an apparatus and related method for displaying advertising above the roof of a vehicle, and comprising a rigid aerodynamic member having a leading edge, a trailing edge and side surfaces between the edges, with the side surfaces tapering rearwardly to the trailing edge. Means are provided for attaching the member to a vehicle, for example to a window of the vehicle with the side surfaces extending generally vertically, and with at least one of the side surfaces defining an area to which an advertising medium can be affixed.

The aerodynamic member has a longitudinal dimension between the edges and lateral dimensions between the side surfaces, in which the longitudinal dimension is substantially greater than the lateral dimensions in order to enhance the aerodynamic characteristics of the member. It is also preferred that the longitudinal dimension extend generally parallel with the direction of vehicle travel.

Suitably, the attaching means includes at least one upstanding brace which extends into the aerodynamic member, and is rigidly fixed with a window mount having a lateral hook portion dimensioned to pass across the top of the vehicle window, and means (such as a suction cup) for releasably attaching the window mount and the upstanding brace assembly across the face of the window. In the preferred embodiment, the lateral hook portion includes a series of graduated steps which permit positive engagement of the top of the vehicle window, and prevents movement of the lateral hook portion when the window is raised in positive contact with the underside of the hook portion. The window mount is formed of a generally transparent plastic material, in order to permit the driver to see through the window mount.

The rigid aerodynamic member preferably comprises a hollow, unitary member of a molded plastic sheet, with the leading edge forming an enclosed curved surface across the front of the aerodynamic member.

In use, the brace suspends the aerodynamic member above and out of contact with the vehicle, and is removably attached to the window only across the hook portion and the removable suction cup. The enclosed form of the aerodynamic member permits the use of lights within its hollow enclosure, while the enclosed nature of the aerodynamic member protects the lighting fixtures from moisture during use. The series of graduated steps across the hook portion permit the brace and window mount to be positioned at different angles, in order to take into account the different angular position of windows for different makes of automobiles.

THE DRAWING

Figure 1:
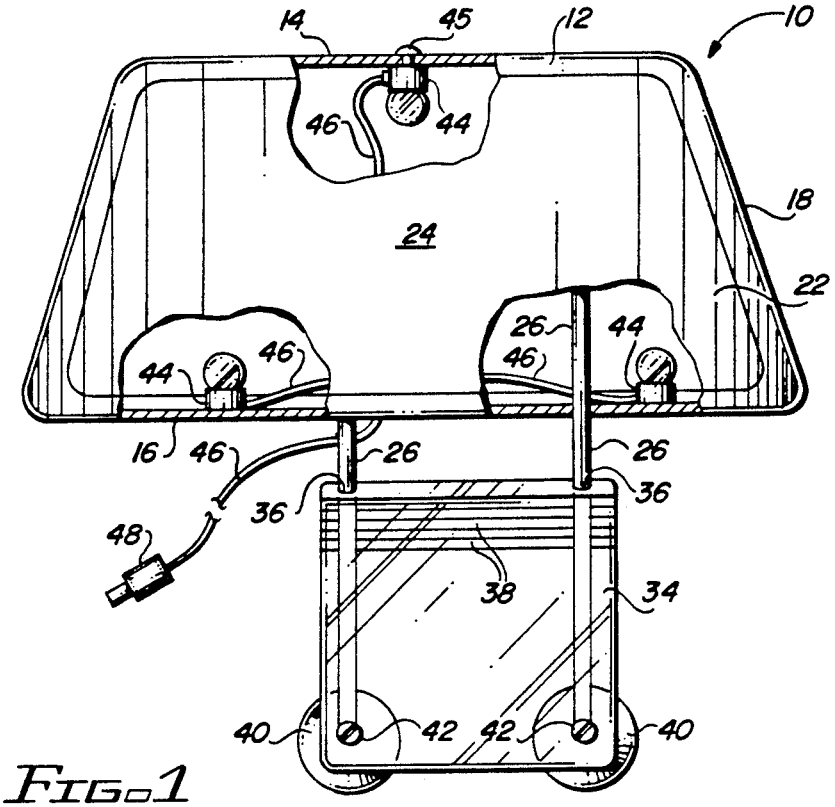
FIG. 1 is a side elevation of one form of a removable advertising sign in accordance with the present invention.
Figure 3:
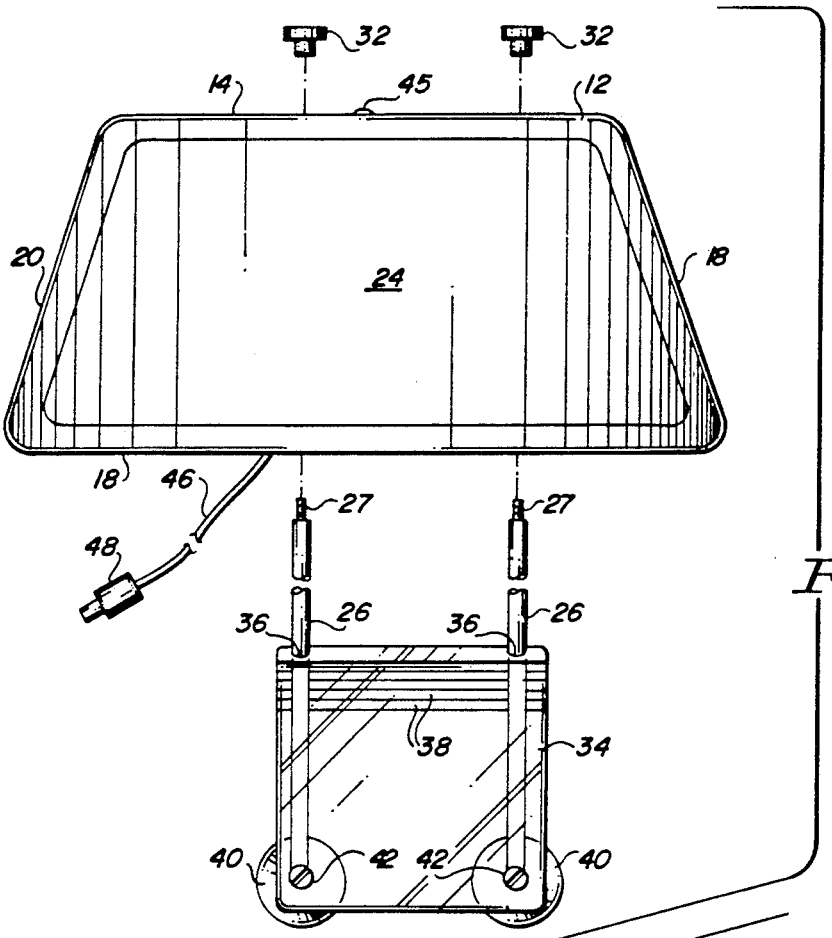
FIG. 3 is an exploded side elevation of the advertising sign shown in FIG. 1, a portion of which is shown cut away to illustrate the internal lighting system
Figure 4:
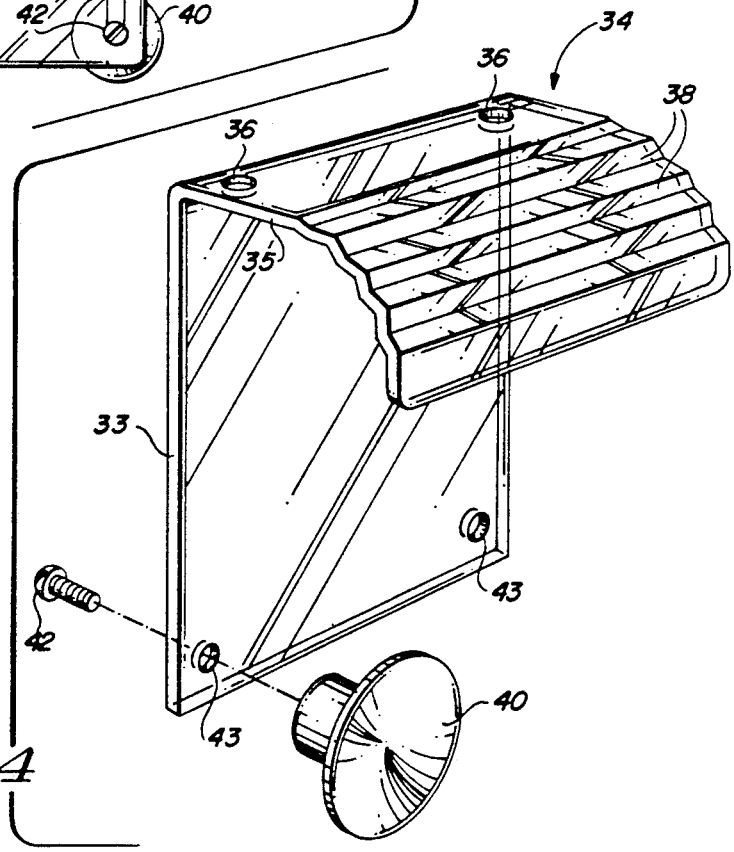
FIG. 4 is a perspective, exploded view of a portion of the advertising sign shown in FIGS. 1 and 3.
Figure 5A:
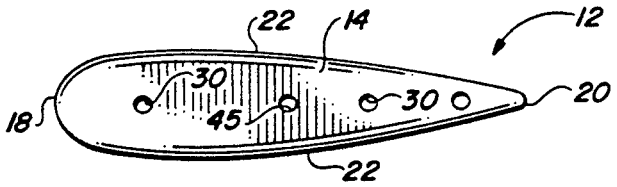
Figure 5B:
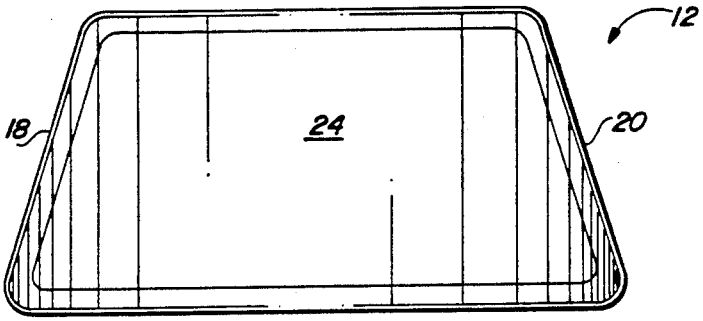
Figure 5C:
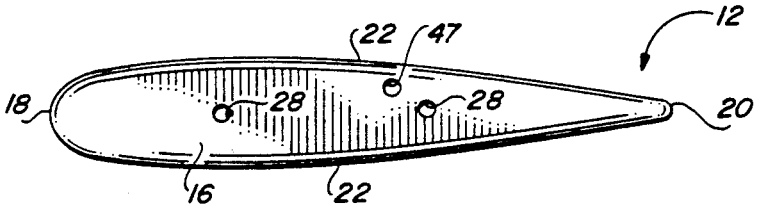

FIGS. 5A–C are top, side and bottom views, respectively, of the rigid aerodynamic member which forms a part of the advertising sign shown in FIGS. 1 and 3.

Figure 6A:
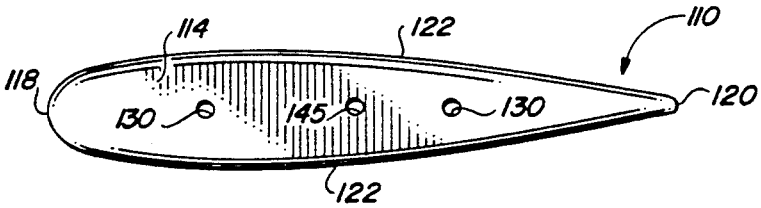
Figure 6B:
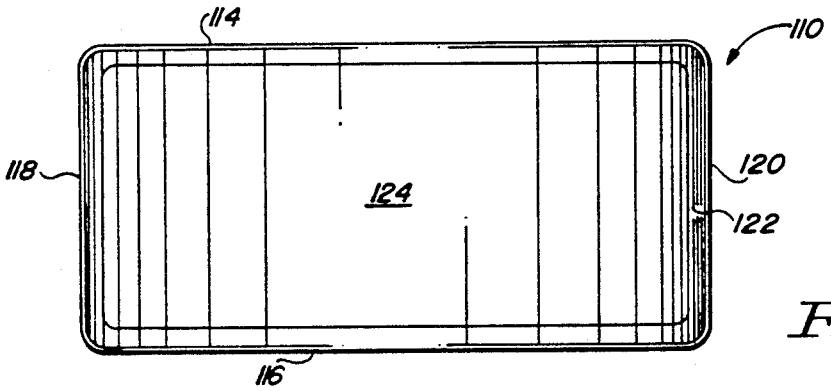
Figure 6C:
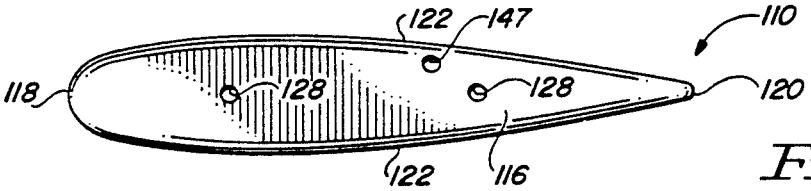

FIGS. 6A–C are top, side and bottom views, respectively, of an alternate form of the rigid aerodynamic member useful in the advertising sign of the present invention.

Figure 7:
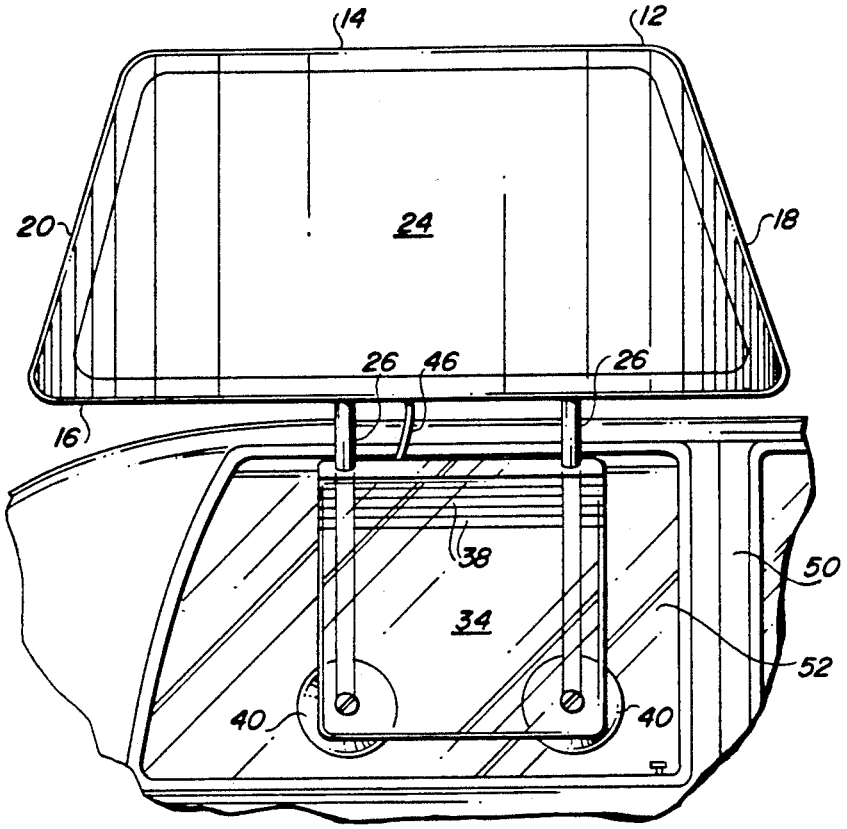
Figure 8:
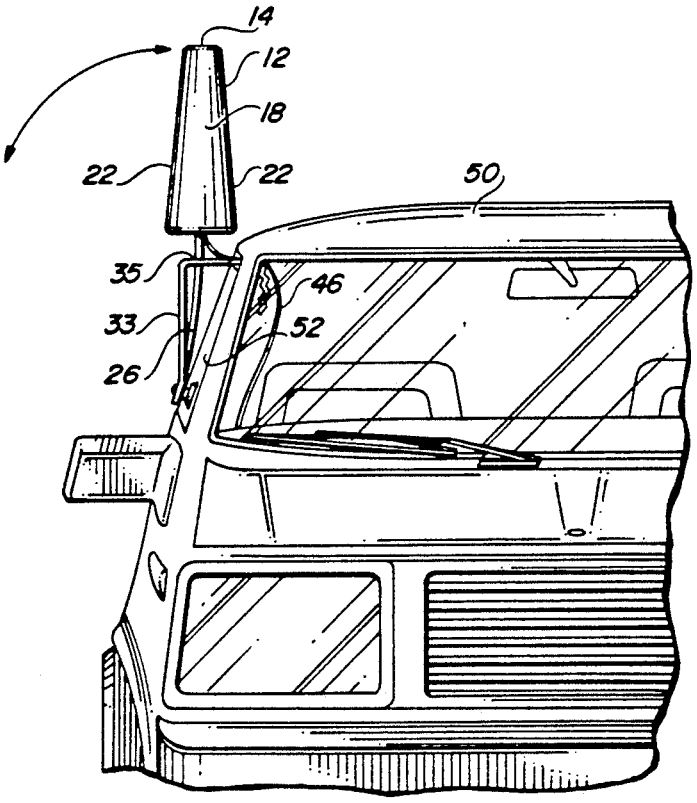

FIGS. 7 and 8 are side and front views, respectively, illustrating the manner in which the advertising sign of the present invention is used.

DETAILED DESCRIPTION OF THE PREFERRED EMBODIMENT

The preferred embodiment of the present invention will now be described with reference to FIGS. 1, 3, 4, 5A–C, 7 and 8, where the removable advertising sign of the present invention is referred to generally by the reference numeral 10.

The advertising sign 10 comprises an enclosed, rigid aerodynamic member 12 having a top surface 14, a bottom surface 16, a curved leading edge 18 and a curved trailing edge 20. The opposing sides 22 of the rigid aerodynamic member 12 form surfaces 24 upon which advertising messages may be placed. Preferably, the rigid aerodynamic member is formed of a unitary, hollow molded plastic sheet and has a longitudinal dimension between the leading and trailing edges 8, 20 and a lateral dimension between the sides 22, and in which the longitudinal dimension is substantially greater than the lateral dimension. As is shown in FIGS. 5A and 5C, the lateral dimension varies from a wider dimension adjacent the leading edge to a narrow dimension adjacent the trailing edge.

In the form of the aerodynamic member shown in FIGS. 5A–C, the leading and trailing edges 18, 20 are tapered upwardly, so that the top surface 14 is smaller than the bottom surface 16. In the form of the aerodynamic member 116 shown in FIGS. 6A–6C, the leading and trailing edges 118 and 120 are parallel, and thus the top surface 114 and the bottom surface 116 are of the same dimension. (In FIGS. 6A–6C, the reference numerals are the same as those used in FIGS. 5A–C, except that the reference numerals are preceded with the numeral "1").

The construction of the hollow, enclosed and rigid aerodynamic members 10, 110, as shown in FIGS. 5A–5C and FIGS. 6A–6C, respectively, provide an aerodynamic configuration which has a minimum of wind drag when mounted upon a vehicle. As can be seen, the shape of the aerodynamic members 10, 110 are somewhat similar to an aircraft wing, in order to reduce drag, but of course are mounted in a vertical, rather than horizontal direction when in use.

Referring again to FIGS. 1, 3, 4 and 5A–C, the aerodynamic member 12 is supported upon a mounting bracket 34 by vertical braces 26, which extend through openings 28 in the bottom 16 of the member 12, and are attached via fasteners 32 through openings 30 in the top 14 of the member 12. The window mount 34 (FIG. 4) includes a vertical portion 33 and a generally horizontal hook portion 35, the hook portion 35 including a plurality of graduated steps, or corrugations, 38 which step downwardly so as to permit the mount 34 to be positively engaged with a raised window, as described in greater detail below. The mount 34 includes apertures 36 for receiving the braces 26, and a pair of openings 43 through which a fastener 42 is extended to engage a suction cup 40, the suction cup permitting removable attachment to a window, as shown in FIG. 7. The mount 34 is preferably formed of a transparent plastic material, such as plexiglass or LEXAN.

As shown in FIGS. 3 and 5C, lighting fixtures 44 are included within the aerodynamic member 12, and are coupled to a plug 48 via electric wire 46. The plug may be removably engaged into a conventional automobile cigarette lighter in order to illuminate the sign 10. The lighting fixture 44 is attached to top 14 of the aerodynamic member 12 with a fastener 45, and the electric wire exits the rigid aerodynamic member 12 via an opening 47 in the bottom 16.

Figure 2:
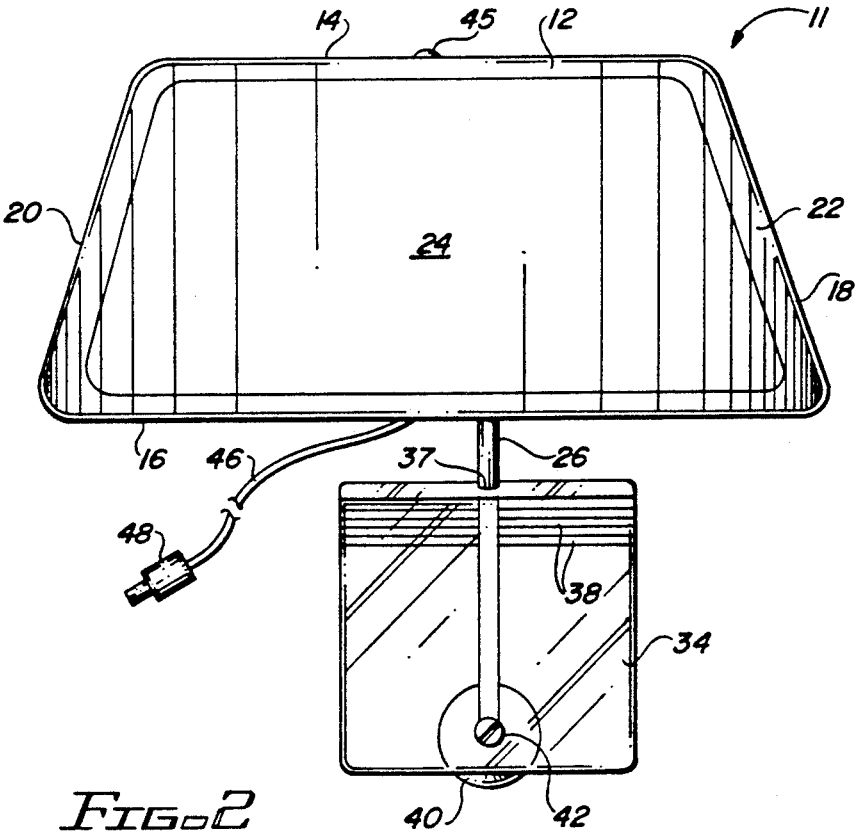
FIG. 2 is a side elevation of an alternate form of the advertising sign shown in FIG. 1.

An alternate form of the advertising sign is shown in FIG. 2 and referred to generally with the reference numeral 11. The advertising sign 11 of FIG. 2 is essentially identical to the advertising sign 10 in FIG. 1, except that the sign is supported by a single vertical brace 26 extending through a single opening 37 along the hook portion 35 of the mount 34. It will be appreciated by those skilled in the art that the sign 11 may be firmly attached to the brace 26, or alternatively may be loosely attached to that brace, so that the rigid aerodynamic member 12 rotates from side to side depending upon prevailing air currents across the leading edge 18 and the sides 22.

The manner in which the advertising sign 10 is removably mounted upon an automobile window will now be described with reference to FIGS. 7 and 8. As there shown, the mount 34 is fixed to the window by extending the hook portion 35 through the window, permitting the graduated steps 38 to extend through the window and be positively engaged by the bottom of the window, after it is raised. The suction cups 40 removably engage the outside surface of the window 52 of the vehicle 50. The electrical wire 46 is extended through the partially opened window 52, and the plug 48 is engaged in the cigarette lighter of the vehicle 50. As will be appreciated from the front elevation of FIG. 8, the graduated steps of the hook portion 35 permit the angular displacement of the advertising sign 10, thus permitting adjustment to account for different angular displacements for different automobile windows.

It will also be appreciated by those skilled in the ar that various modifications and adaptations of the present invention may be employed.

What is claimed is:

1. Apparatus for displaying an advertisement above the roof of a vehicle, comprising:

a vehicle having a wide window which extends generally vertically and approximately parallel to the direction of vehicle travel;

an aerodynamic member having a leading edge, a trailing edge and side surfaces between the edges, the member having a longitudinal dimension between the edges and lateral dimensions between he side surfaces, the longitudinal dimension being substantially greater than the lateral dimensions;

means including an upstanding race means for releasably attaching the aerodynamic member to the vehicle window with he side surfaces extending generally vertically, the attaching means including a window mount having a portion dimensioned to pass across the top and engage the vehicle window;

the upstanding brace mean rigidly joined with the window mounted at spaced points and joined with the aerodynamic member at spaced point, so as to prevent rotation of the aerodynamic member and maintain the longitudinal dimension extending in a direction generally parallel with the direction of vehicle travel; and wherein at least one of the side surfaces defines an area to which an advertising medium can be affixed.

2. The apparatus a recited in claim 1 wherein the lateral dimensions vary from a wider dimension just rearwardly of the leading edge to a narrow dimension adjacent their trailing edge.

3. The apparatus recited in claim 1 wherein he aerodynamic member has an upper surface and a lower surface, the supper and lower surfaces extending between the leading and trailing edges and along opposing ends of the side surfaces, and wherein the attaching means is coupled to the lower surface.

4. The apparatus recited in claim 3 wherein the leading and trailing edges taper from a large dimension adjacent the upper surface.

5. The apparatus recited in claim 1 further comprising:

the window mount having a lateral hook portion dimensioned to pass across the top of the vehicle window.

6. The apparatus recited in claim 5 wherein the lateral hook portion o the window mounted comprises means for positively engaging the top of a vehicle window.

7. The apparatus recited in claim 6 wherein the positive engaging means comprises plural graduated steps extending across and downwardly along the lateral hook portion.

8. The apparatus recited in claim 5 wherein the means for releasably attaching the window mount and upstanding brace assembly comprises at least one suction device.

9. The apparatus recited in claim 5 wherein the upstanding brace extends through and is rigidly joined with the window mount.

10. The apparatus recited in claim 9 wherein the releasably attaching means comprises a suction cup fixed with the lower extremity of the upstanding brace and with the window mount.

11. The apparatus recited in claim 1 wherein the aerodynamic member comprises a hollow, unitary member of molded plastic.

12. The apparatus recited in claim 11 wherein the leading edge is an enclosed, curved surface.

13. In combination:

a motor vehicle having a roof and a side window which is movable between open and closed positions;

a rigid member having an enclosed leading edge, an enclosed trailing surface and enclosed side surfaces between the leading edges and the trailing surface, and the member formed of a hollow unitary molded member;

a mounting unit positioned alongside and removably attached to the window;

means for detachably fixing the mounting unit to the window when the window is at least partially closed;

an upstanding brace extending through the mounting unit and into the member, the upstanding brace dimensioned so as to position the member at or above the level of the roof the upstanding brace rigidly joined with the mounting unit at spaced points and joined with the rigid member at spaced points, so as to prevent rotation of the rigid member and maintain the longitudinal dimension extending in a direction generally parallel with he direction of vehicle travel; and wherein the side surfaces form an area upon which an advertising medium can be fixed.

14. A method for displaying an advertising medium above the level of the roof of a vehicle having a side window which may be opened and closed, comprising the steps of:

providing an advertising member having at least one generally flat side dimensioned to receive an advertising message;

providing a mounting unit having a hook portion with graduated steps extending generally horizontal across the hook portion;

extending the mounting unit into the window of the vehicle and then closing the window and locking the mounting unit thereto at a selected one of the graduated steps corresponding to a vertical positioning of the advertising member;

detachably fixing the mounting unit to the outside of the window; and extending an upstanding brace between the mounting unit and the advertising member.

15. The method recited in claim 14 further comprising the step of angularly rotating the mounting unit toward or away from the window before locking the mounting unit in the window, in order to position the advertising member at a desired angle relative to the horizontal plane.

16. In combination:

a motor vehicle having a roof and a side window which is movable between open and closed positions;

a rigid member having an enclosed leading edge, an enclosed trailing surface, enclosed side surfaces between the leading edges and the trailing surface and a bottom surface;

a mounting unit positioned alongside and removably attached o the window;

means for detachably fixing the mounting unit to the window when the window is at least partially closed;

upstanding brace means attached with the mounting unit and extending into and joined with the rigid member at spaced points along the bottom surface so as to prevent rotation the aerodynamic member and maintain the leading edge toward the direction of vehicle travel, the upstanding brace means dimensioned so and to position the member at or above the level of he roof; and wherein the side surfaces form an area upon which an advertising medium can be fixed.

17. Apparatus for displaying an advertisement above the roof o a vehicle, comprising:

a motor vehicle having a generally vertical panel, such as a side window; 'an aerodynamic member having a leading edge, a trailing edge and side surfaces between the edges, the member having a longitudinal dimension between the edges and lateral dimensions between he side surfaces, the longitudinal dimension being substantially greater than the lateral dimensions;

means including an upstanding brace means for releasably attaching the aerodynamic member to the general vertical vehicle panel with the side surfaces extending generally vertically, the attaching means including a window mount having a portion dimensioned to pass across the top and engage the vehicle panel;

the upstanding brace means rigidly joined with the window mount at spaced points and joined with the aerodynamic member at spaced points, so as to prevent rotation of the aerodynamic member and maintain the longitudinal dimension extending in a direction generally parallel with the direction of vehicle travel; and wherein at least one of the side surfaces defines an area to which an advertising medium can be affixed.

* * * * *

UNITED STATES PATENT AND TRADEMARK OFFICE

CERTIFICATE OF CORRECTION

PATENT NO. : 5,084,994

DATED : February 4, 1992

INVENTOR(S) : William A. Elmer

It is certified that error appears in the above-indentified patent and that said Letters Patent is hereby corrected as shown below:

Col. 2, line 47: Change "8" to --18--.
Col. 3, line 37: After "sign" add --11--.
Col. 4, line 07: Change "he" to --the--.
Col. 4, line 10: Change "race" to --brace--.
Col. 4, line 17: Change "mounted" to --mount--;

Col. 4, line 18: Change "point" to --points--.
Col. 4, line 32: Change "supper" to --upper--.
Col. 4, line 38: (Claim 4) After "adjacent", add --the lower surface to a smaller dimension adjacent--.
Col. 4, line 45: Change "o" to --of--.
Col. 5, line 22: Change "he" to --the--.
Col. 6, line 09: Change "o" to --to--.
Col. 6, line 36: Change "general" to --generally--.

Signed and Sealed this

Eighteenth Day of January, 1994

*Attest:*

Bruce Lehman

BRUCE LEHMAN

*Attesting Officer*

*Commissioner of Patents and Trademarks*